US006186849B1

(12) United States Patent
Corazza

(10) Patent No.: US 6,186,849 B1
(45) Date of Patent: Feb. 13, 2001

(54) PROCESS FOR THE PRODUCTION OF FLAT-SCREEN GRIDS COATED WITH NON-EVAPORABLE GETTER MATERIALS AND GRIDS THEREBY OBTAINED

(75) Inventor: Alessio Corazza, Como (IT)

(73) Assignee: Saes Getters S.p.A., Lainate (IT)

( * ) Notice: Under 35 U.S.C. 154(b), the term of this patent shall be extended for 0 days.

(21) Appl. No.: 09/414,820

(22) Filed: Oct. 17, 1999

Related U.S. Application Data

(62) Division of application No. 09/046,619, filed on Mar. 24, 1998.

(51) Int. Cl.[7] ..... H01J 9/39
(52) U.S. Cl. ..... 445/24; 252/181.7; 445/41
(58) Field of Search ..... 445/24, 41; 252/181.7

(56) References Cited

U.S. PATENT DOCUMENTS

| | | | | |
|---|---|---|---|---|
| 3,203,901 | | 8/1965 | Della Porta . | |
| 3,652,317 | * | 3/1972 | Della Porta et al. | 252/181.7 |
| 4,071,335 | | 1/1978 | Barosi . | |
| 4,306,887 | | 12/1981 | Barosi et al. . | |
| 4,312,669 | | 1/1982 | Boffito et al. . | |
| 4,534,744 | * | 8/1985 | Kuznetzoff | 445/24 |
| 4,839,085 | | 6/1989 | Sandrock et al. . | |
| 4,898,557 | * | 2/1990 | Engemann | 445/24 |
| 5,180,568 | | 1/1993 | Boffito et al. . | |
| 5,223,766 | * | 6/1993 | Nakayama et al. | 445/41 |
| 5,283,500 | * | 2/1994 | Kochanski | 313/309 |
| 5,894,193 | * | 4/1999 | Amrine et al. | 313/495 |
| 5,934,964 | * | 8/1999 | Carella et al. | 445/41 |

FOREIGN PATENT DOCUMENTS

| | | |
|---|---|---|
| 0392615 | 10/1990 | (EP) . |
| 0455262 | 11/1991 | (EP) . |
| 995821 | 6/1965 | (GB) . |
| 1139195 | 1/1969 | (GB) . |
| 9523425 | 8/1995 | (WO) . |
| 9601492 | 1/1996 | (WO) . |
| 9803987 | 1/1998 | (WO) . |

* cited by examiner

*Primary Examiner*—Kenneth J. Ramsey
(74) *Attorney, Agent, or Firm*—Hickman Coleman & Hughes, LLP

(57) ABSTRACT

A process is disclosed for making grids for flat-panel displays. The screen grids are coated with non-evaporable getter materials and the metal sheet forming the grid is coated with a coating that is as thick as the resulting grid and having at least the same surface area as the image formation zone of the flat-panel display. At least one side of the grid is coated with one or more non-evaporable getter materials and then parts of the sheet thereby coated are selectively removed. Some embodiments of grids produced with such a process are also disclosed.

28 Claims, 3 Drawing Sheets

PROCESS FOR THE PRODUCTION OF FLAT-SCREEN GRIDS COATED WITH NON-EVAPORABLE GETTER MATERIALS AND GRIDS THEREBY OBTAINED

This Appln is a Div of aplication Ser. No. 09/046,619 filed Mar. 24, 1998.

BACKGROUND AND SUMMARY OF THE INVENTION

The present invention relates to a process for producing flat-screen grids coated with non-evaporable getter materials and to the grids thereby obtained.

Intense interest has been directed to flat screens for several years as a replacement to conventional-sized bulky television-kinescopes and computer-screens. Among the various suggested types of flat screens, the so-called field emission displays (FEDs) seem to be particularly promising. Generally, a FED involves welding two flat glass members along their perimeter. The welding is carried out by melting a low-melting glass paste with an operation called "frit-sealing". The resulting structure is formed of two mutually parallel surfaces at a distance ranging from a few tenths of millimeters to 2–3 millimeters, thus defining an internal space. A plurality of sharpened microcathodes, made of metallic material, e.g. molybdenum, are provided on the inner surface, of the rear part, except along the edges. A plurality of grid electrodes are placed in close proximity to the microcathodes so that applying a small potential difference can produce a high voltage electric field that can extract electrons from the microcathodes. The electronic current is accelerated towards the phosphors placed on the inner surface of the front part, except for the edges. The zone containing the phosphors, corresponding and opposite to the zone having the microcathodes, is the image formation zone. The screen image is formed by selectively exciting only some phosphors.

In FEDs, the microcathodes and the phosphors are a few tenths of millimeters apart. The phosphors are selectively excited simply by selectively activating groups of microcathodes since the electronic beam is sufficiently collimated at these distances. However, one or more electric grids are needed to accurately direct the electronic beam to selectively excite phosphors in FEDs with an internal space that is 2–3 millimeters thick. These grids are generally formed of metal sheets that have a thickness ranging from 20 to 200 $\mu$m and have the same surface area as the screen. The grids have a plurality of pinholes of size ranging from about 30 to 200 $\mu$m and are spaced about 30–300 $\mu$m apart.

The internal space of the FED must be kept evacuated to avoid dispersing the electronic beam. The residual pressures are usually more than $10^{-3}$ mbar for hydrogen, and not more than $10^{-4}$, and preferably less than $10^{-6}$ mbar, for other gases. Gases of various types may be emitted by the same FED composing materials during operation. As disclosed in patent applications WO 95/23425 and WO 96/01492, assigned to the Assignee of this application, herein incorporated by reference, maintaining the necessary vacuum inside the FEDs involves using non-evaporable getter materials, also known as NEG, that can fix gases such as $O_2$, $H_2O$, CO, $CO_2$ and $N_2$.

At present, the NEG devices are disposed inside the FEDs in form of little pills or thin layers on the edges of the zone having the cathodes. This operation of the devices, however, transfers gas only slowly from the middle zone of the screen to the edges. This slow gas transfer can be a problem, particularly for large-sized FEDs, due to the thinness of the evacuated space of the FEDs space. Harmful gas concentration gradients can form inside the FEDs and hinder its proper operation.

It is an object of the present invention to deposit getter material so that it is spread out regularly on the entire screen surface.

This object is achieved according to the present invention, which in its first aspect relates to a process for the production of flat-screens grids coated with getter materials. The process involves providing a metal sheet being as thick as the resulting grid and having a surface area large at least as the image formation zone. The sheet is coated with one or more non-evaporable getter materials at least one side of the metal sheet. Portions of the metal sheet that are coated with getter material are then selectively removed.

All of these objectives, features and advantages of the present invention, and more, are illustrated below in the drawings and detailed description that follows.

BRIEF DESCRIPTION OF THE DRAWINGS

The invention will be hereinafter described with reference to the drawings, wherein.

DETAILED DESCRIPTION

Figure 1:
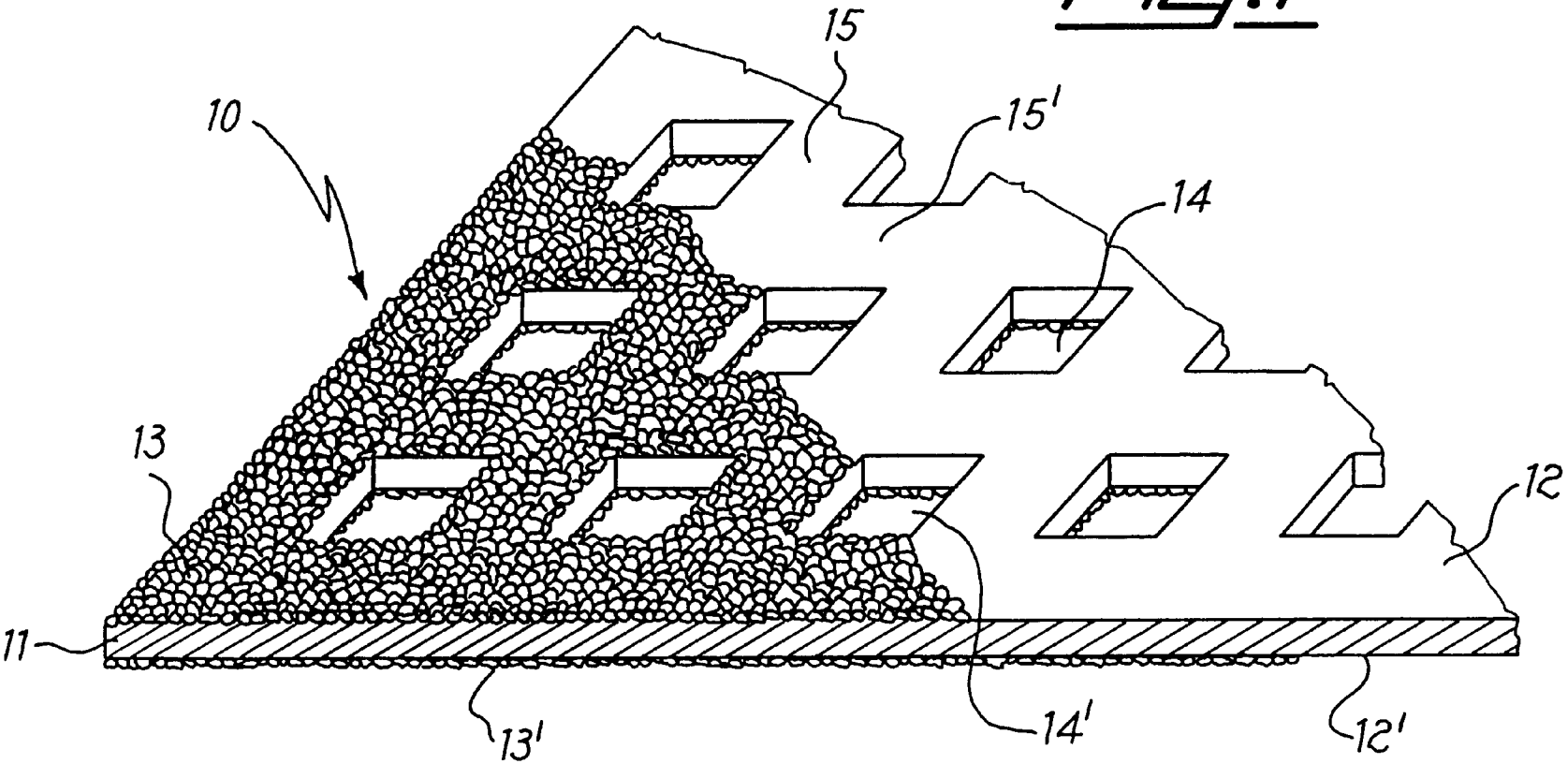
FIG. 1 shows a possible grid coated with getter material, obtained according to the invention.

The metal sheet used in the present invention starts with one having the usual features required for producing television-screens grids, namely the metal sheet must be easily formable and have a reduced gas emission in a vacuum. Furthermore, it must have good adhesion properties for getter material powders. The preferred materials for this purpose are nickel and its alloys, as nickel-chromium alloys, or the alloy named INVAR, formed of about 64% by weight of iron and 36% by weight of nickel. The sheet thickness generally ranges from about 20 $\mu$m to 100 $\mu$m.

The metal sheet must have at least the same surface area as the image formation zone. Preferably, the surface of the sheet is slightly larger than the surface of the image formation zone, such as to provide an outer edge not having holes made thereon, as hereinafter described. This edge may be useful for fixing the sheet inside the FEDs, and may be coated with the NEG material deposit, thereby providing an additional amount of this material. Alternatively, the edge may be kept free from the NEG material deposit, thereby favoring the operations for fixing the grid to the FED structure. Finally, intermediate solutions are possible, wherein the edge is only partly coated with the NEG material deposit, e.g., by coating two opposite side edges and keeping free the other two opposite side edges, thereby achieving a compromise between the foregoing advantages. It is also possible to use sheets that have a surface area far larger than the image formation zone, equal to about multiple thereof or of this plus an edge. In this case the resulting grids are obtained by cutting suitably sized pieces from the starting sheet after depositing the NEG material thereon.

The metal sheet may be coated with getter material on one or both its sides. Many techniques are available for producing supported thin layers of powders and can be used to coat the metal sheet with the NEG material deposit. These known techniques include cold rolling, spray techniques or serigraphic techniques. The process for coating metal supports with NEG materials by cold rolling is well known in the metallurgical field, while the spray coating is disclosed in, for example, patent application WO 95/23425 which is assigned to the Assignee of this application and hereby incorporated by reference. It is thought somewhat better to use the serigraphic technique, since this tecnhique seems to obtain the greatest uniformity of the getter material layer for coating on large surfaces.

In order to obtain a getter material layer according to the serigraphic technique, a suspension of the material powders is first prepared in a water, alcohol, or hydroalcohol suspending medium. This medium also has amounts of high-boiling organic compounds to serve as viscosity adjusters that consume less than 1% of the total weight of the suspension. The suspension thereby obtained is then spread onto a net screen made of plastic material, with ports having a range of sizes from 10 to 200 $\mu$m. The net screen is stretched on a rigid frame and kept at a distance from the substrate ranging from 0.5 to 2 mm. A shim can apply suitable rubber or metal sleekers on the upper side of the net screen having the suspension thereon. This is forced into the net screen ports, thereby forming a deposit on the substrate. This deposit is then dried and sintered to obtain the resulting coated sheet. The details of the preparation of NEG material layers with the serigraphic technique are known from WO 98/03987, which is assigned to the Assignee of this application and herein incorporated by reference. Another advantage of the serigraphic technique is that shaped powders deposits can be obtained by selectively obstructing the net screen ports according to any predetermined pattern. It is particularly easy, for example, to produce metal sheet coatings having their edges totally or partly free from the NEG material for such purposes. Shaped deposits also may be obtained by replacing the serigraphic net screen with suitable metal plates.

The thickness of the NEG material layer after sinterization ranges from about 20 $\mu$m to about 100 $\mu$m. Deposits that are too thin may make too little getter material available, and deposits that are too thick may make the coated sheet difficult to cut properly to obtain the grid holes. Considerations of the mechanical stability of the grid favor keeping the deposit thinner than the sheet. The two deposits on the opposite sides can have the same or at least a similar thickness, in order to prevent sheet distortions in subsequent sinterization of the deposit when the deposit is produced by spray or serigraphic technique and the sheet is coated on both sides.

The NEG material used for the sheet coating may be any of the known NEG materials, such as, for example, zirconium, titanium, niobium, hafnium, tantalum, tungsten metals, mixtures and alloys thereof comprising these or other metals, generally selected among those belonging to the first transition series and aluminum. It may be preferred to use the getter alloys disclosed in patents U.S. Pat. No. 3,203,901, U.S. Pat. No. 4,071,335, U.S. Pat. No. 4,306,887, U.S. Pat. No. 4,312,669, U.S. Pat. No. 4,839,085, U.S. Pat. No. 5,180,568, incorporated by reference; or zirconium-cobalt alloys containing about 75–90% by weight of zirconium, or alloys therefrom obtained by adding rare earths up to 10% of the total alloy weight; or further titanium-vanadium and titanium-chromium alloys containing about 70–80% by weight of titanium. It is particularly preferred to use the alloy containing 70% by weight of zirconium, 24.6% by weight of vanadium and 5.4% by weight of iron, that is commercially available from the Assignee under the trade name of St 707. Mixtures of several alloys or mixtures of alloys and the above-mentioned getter metals may also be used. Powder of a metal such as nickel or titanium may be added to the mixtures of metal powders or above-mentioned getter alloys if the deposit is produced by spray or serigraphic technique. Their amount can range from about 2% to 20% by weight of the whole mixture. Their presence can help in sintering the layer of powders.

The last process step consists of selectively removing parts of the NEG material on the coated metal sheet by making holes for passage of the electron beams. The holes are generally square, rhombohedrical, round, triangular or elliptical in shape, have size ranging from about 50 to 200 $\mu$m, and are spaced apart by metal members having a width ranging from 50 to 300 $\mu$m. Achieving good image quality requires that the holes be as even as possible and have sharp and regular edges. To make these holes, it is preferable to use chemical-etching since this allows a cutting accuracy of about 10 $\mu$m.

Chemical-etching is the preferred technique in case of sheets coated with NEG material on a single side. The operations related to the chemical-etching technique can be performed on the opposite side with respect to the side that is coated with the NEG material. Alternatively, the laser-cutting technique may be employed which is the preferred technique when the sheets are coated with NEG material on both sides. Laser-cutting can produce a cutting width of about 30 $\mu$m and a suitable accuracy for the production of FED grids. Furthermore, the laser-cutting causes the sheet to locally melt; this avoids the presence of cutting burrs caused by mechanical cutting. Further, this local melting cooperates to fix the NEG material particles to the cutting edge so that the NEG material cannot become detached and generate metal powders inside the FED. The presence of either burrs at the cutting edge or of loose powders may generate spurious electric fields, thus modifying the electron beam emission or transmission and adversely affecting image formation.

The metal members that space the grid holes apart can be about 50–300 $\mu$m wide. It is preferable to end up with a regular coating. This can be achieved using NEG materials powders having fine particle size, preferably smaller than about 50 $\mu$m for the grids with lower definition (holes size and metal members therebetween). As the grid definition increases, the maximum powders particle size which can be used decreases, and for the finer grids it is preferable to use powders having smaller than about 20 $\mu$m.

Another aspect the invention relates to the grids obtained with the above-mentioned process. Some possible grids are hereinafter described, by way of non-limiting examples of the scope of the invention, with reference to the drawings.

FIG. 1 shows a perspective view of a portion of a possible grid obtained with the process of the invention in which the NEG material covers all the available surface. The grid 10 is formed of a metal sheet 11 coated on both sides 12, 12' with NEG material deposits 13, 13'. A plurality of holes 14, 14', . . . , are spaced apart by metal members 15, 15' . . . , that are coated with the NEG material. To make the representation simple, and to provide a clear idea of the grid geometry, FIG. 1 shows the NEG material coating only a portion of the two sides of sheet 11. The NEG material is intended to be able to coat the entire sheet. Furthermore, although FIG. 1 shows a portion of the metal sheet without NEG material and with holes 14, 14', it should be understood that the process of the present invention can obtain these holes when a continuous sheet has been wholly coated with NEG material. Finally, all possible combinations of hole geometries and coating are allowed according to the invention. It is only the grid exemplified in FIG. 1 that has square-section holes for the electron flow passage and coated with a NEG material deposit on both its sides.

Figure 2:
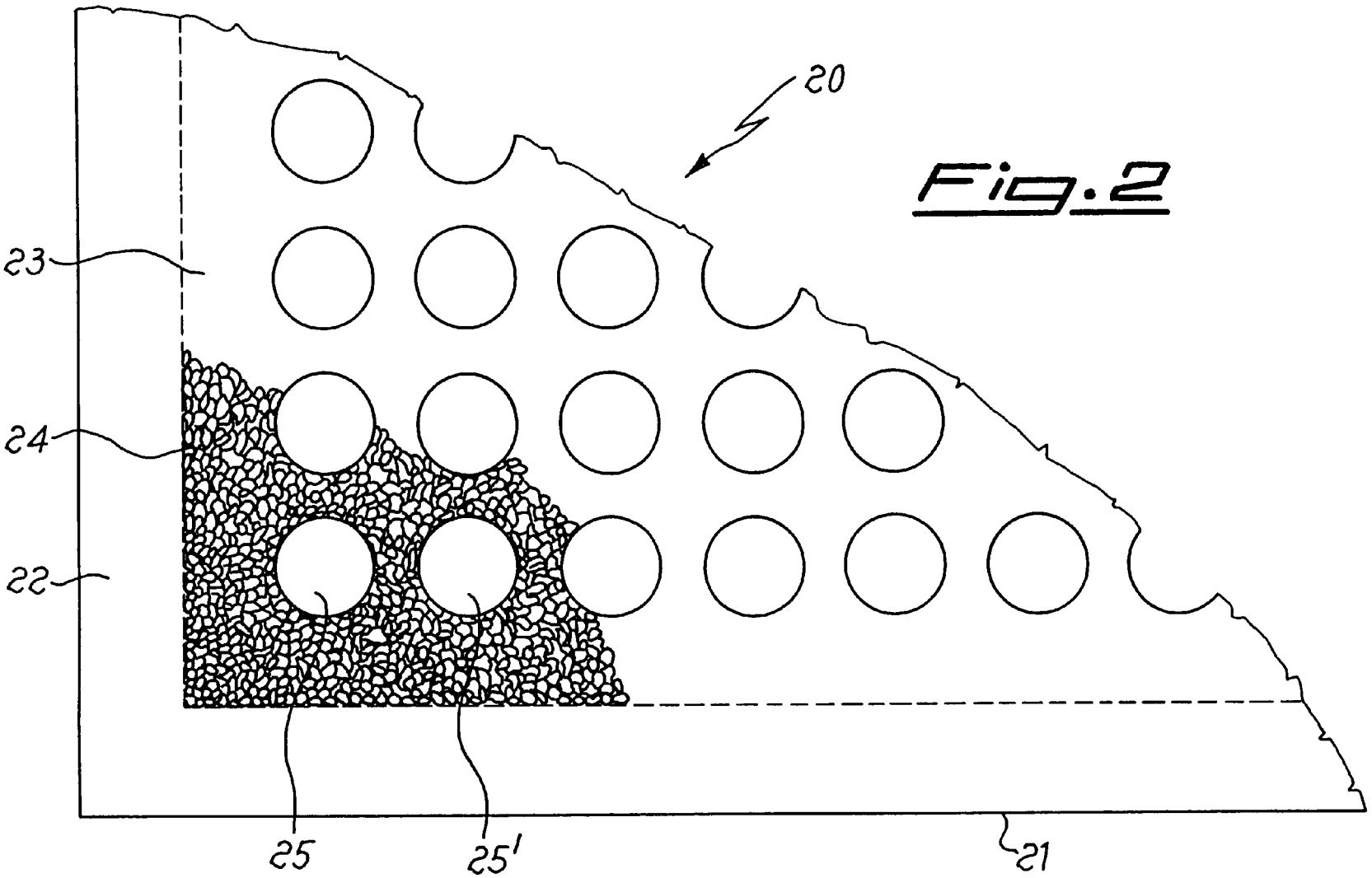
FIG. 2 shows an alternative embodiment of the grid according to the invention.

FIG. 2 shows a plane view of a portion of another possible alternative grid according to the invention in which the edge 21 has no coating of NEG material. The grid 20 is formed from a sheet 21 that has an outer edge 22 that is free of NEG material deposits, and middle zone 23 (enclosed by the hatched lines in the drawing) coated with NEG material deposit 24. In this case, as in FIG. 1, deposit 24 is exemplified as being only partly represented for the sake of clarity. The holes 25, 25' etc., are formed in zone 23 and are made for the passage of electrons. Round holes are disposed in a square screen pattern as exemplified. Again, all possible combinations of possible hole shape and screen pattern are allowed, such as e.g., an hexagonal screen pattern of round holes.

Figure 3:
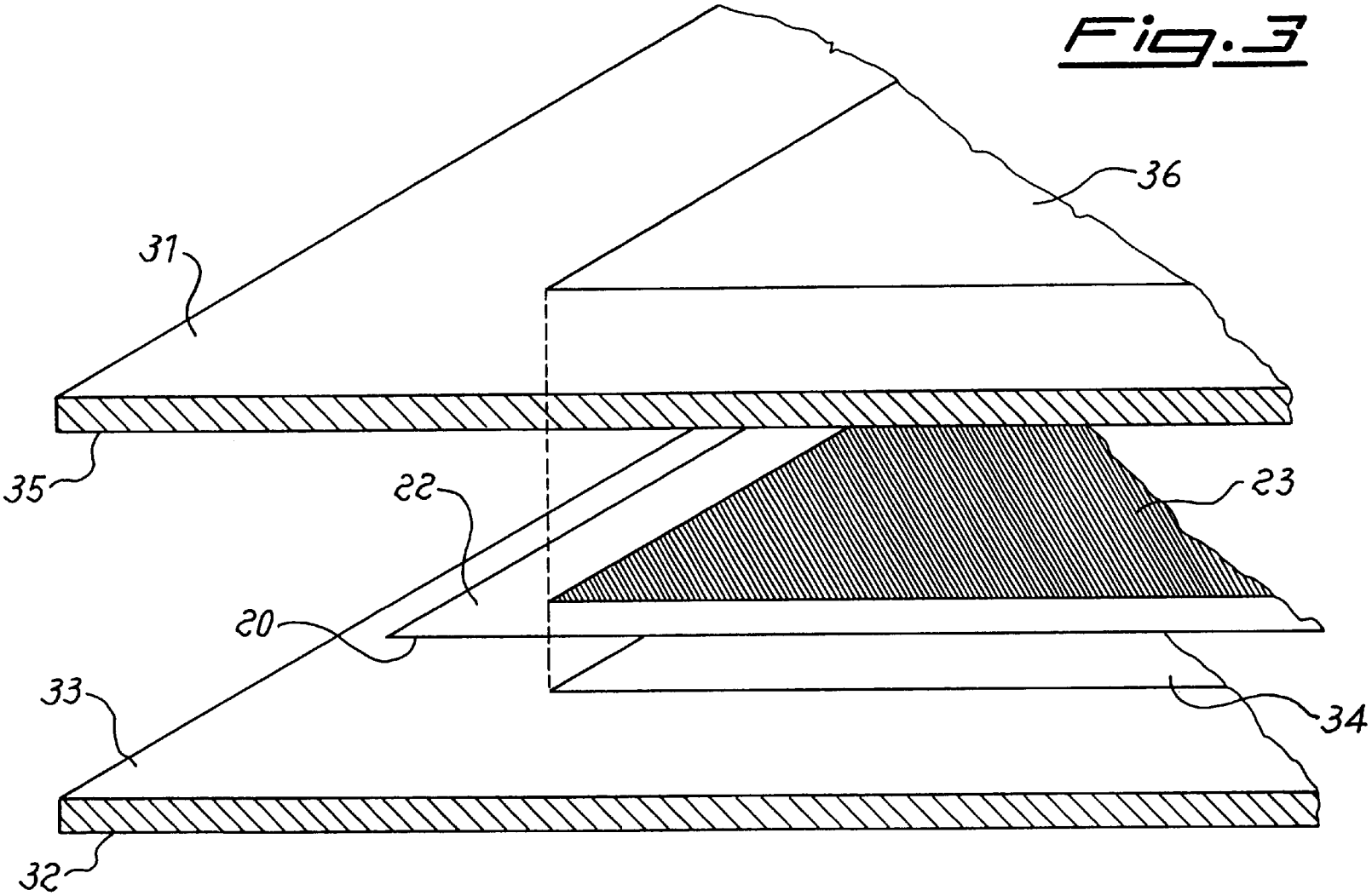
FIG. 3 shows a diagram of an exploded view of a FED comprising a possible grid obtained with the process according to the invention.

FIG. 3 shows an exploded view of a part of a FED comprising a grid of the invention in which the edge is free of NEG material as represented in FIG. 2. In FIG. 3, the FED is made from a front glass portion 31 and a rear portion 32. The grid 20 is placed between these two portions. On inner surface 33 of portion 32 there are the microcathodes (not shown in the drawing) disposed in zone 34. On inner surface 35 of portion 31, in correspondence with zone 34, are the phosphors disposed in zone 36 that is also the image formation zone. The grid 20 is disposed such that zone 23 (wherein there are the holes and the NEG material deposit) is essentially equivalent to the projection of the image formation zone on the grid itself with edge 22 being outside of such projection zone.

The grids coated with the getter materials described herein perform the double task of directing the electron beam and of uniformly spreading the getter material inside the screen. The present invention thereby eliminates the problems of other systems. It is thought less likely that these grids could be obtained by coating pre-perforated metal sheets with getter materials. Trying to sinterize NEG materials deposits on substrates with many close holes such as those required for FED grids causes the substrate to undergo heavy distortions. These distortions are likely due to the interactions between metal and getter material occurring at high temperature.

The principles, embodiments and modes of operation of the present invention have been set forth in the foregoing provisional specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

What is claimed is:

1. A method for producing a flat panel display having a grid coated with getter materials, comprising:

providing a metal sheet being as thick as the resulting grid and having a surface area at least as large as the image formation zone;

coating the metal sheet with one or more non-evaporable getter (NEG) materials at least one side of the metal sheet; and selectively removing portions of the metal sheet after it is coated with the NEG material.

2. A method for producing a flat panel display having a grid as claimed in claim 1, wherein the metal sheet is made of metals selected from the group consisting of nickel, nickel-chromium alloy and nickel-iron alloy.

3. A method for producing a flat panel display having a grid as claimed in claim 1, wherein the metal sheet has a thickness ranging from 20 $\mu$m to 100 $\mu$m.

4. A method for producing a flat panel display having a grid as claimed in claim 1, wherein the metal sheet has the same size as the resulting grid, and the coating wholly coats the grid with the NEG material.

5. A method for producing a flat panel display having a grid as claimed in claim 1, wherein the metal sheet has the same size as the resulting grid, and the coating partly coats the grid with the NEG material deposit, the coating leaving one or more outer edges of the grid free from such deposits.

6. A method for producing a flat panel display having a grid as claimed in claim 1, wherein the metal sheet has a size about equivalent to a multiple of the resulting grid surface, and the coating wholly coats the grid with the NEG material.

7. A method for producing a flat panel display having a grid as claimed in claim 1, wherein the coating coats the metal sheet with the NEG material on a single side.

8. A method for producing a flat panel display having a grid as claimed in claim 1, wherein the coating deposits NEG material on both sides of the metal sheet.

9. A method for producing a flat panel display having a grid as claimed in claim 1, wherein the coating involves cold rolling the NEG material.

10. A method for producing a flat panel display having a grid as claimed in claim 1, wherein the coating involves applying the NEG material by a spray technique.

11. A method for producing a flat panel grid as claimed in claim 10, wherein the coating applies NEG material to both sides of the metal plate and the coating on each side has approximately the same thickness.

12. A method for producing a flat panel display having a grid as claimed in claim 1, wherein the coating deposits the NEG material by a serigraphic technique.

13. A method for producing a flat panel grid as claimed in claim 12, wherein the coating applies NEG material to both sides of the metal plate and the coating on each side has approximately the same thickness.

14. A method for producing a flat panel display having a grid as claimed in claim 1, wherein the coating of NEG material has a thickness ranging from 20 $\mu$m to 100 $\mu$m.

15. A method for producing a flat panel display having a grid as claimed in claim 14, wherein the coating applies a layer of NEG material that is thinner than the metal sheet.

16. A method for producing a flat panel display having a grid as claimed in claim 1, wherein the NEG material is selected from the group consisting of zirconium, titanium, niobium, hafnium, tantalum, tungsten, mixtures and alloys thereof comprising these same metals or other metals selected among those belong to the first transition series and aluminum.

17. A method for producing a flat panel grid as claimed in claim 16, wherein the NEG material is selected from the group consisting of mixtures of zirconium, titanium, niobium, hafnium, tantalum, tungsten and their alloys.

18. A method for producing a flat panel grid as claimed in claim 16, further comprising adding nickel or titanium powder to the NEG material, in amount ranging from 2% to 20% by weight of the whole mixture.

19. A method for producing a flat panel grid as claimed in claim 1, wherein the NEG materials have particle size smaller than about 50 $\mu$m.

20. A method for producing a flat panel grid as claimed in claim 19, wherein the NEG materials have particle size smaller than about 20 $\mu$m.

21. A method for producing a flat panel grid as claimed in claim 1, wherein the selective removing of portions of the coated metal sheet involves a chemical-etching technique.

22. A method for producing a flat panel grid as claimed in claim 1, wherein the selective removing of portions of the metal sheet involves laser-cutting.

23. An article of manufacture for a flat panel display, comprising:

a metal sheet having a surface area as large as at least an image formation zone for the flat panel display;

a coating on the metal sheet, the coating comprising at least one non-evaporable getter (NEG) material; and a plurality of grid holes formed in the metal sheet, the grid holes extending through the coating.

24. An article of manufacture for a flat panel display as claimed in claim 23, wherein the grid holes have a shape selected from the group consisting of square, rhombohedrical, round, triangular and elliptical.

25. An article of manufacture for a flat panel display as claimed in claim 24, wherein the grid holes have a size ranging from about 50 $\mu$m to 200 $\mu$m and further comprising metal members on the metal sheet, the metal members spacing the grid holes apart by 50 $\mu$m to 300 $\mu$m.

26. An article of manufacture for a flat panel display as claimed in claim 24, wherein the grid holes are disposed in a square screen pattern.

27. An article of manufacture for a flat panel display as claimed in claim 24, wherein the grid holes are disposed in a hexagonal screen pattern.

28. A method for producing a flat panel grid as claimed in claim 1, wherein the NEG material is selected from the group consisting of Zr—Al, Zr—Fe, Zr—Ni, Zr—Co, Ti—V, Ti—Cr, Zr—V, Zr—V—Fe, Zr—Mn—Fe and Zr—Co-rare earth alloys.

* * * * *